US011817051B1

(12) United States Patent
Pyun et al.

(10) Patent No.: US 11,817,051 B1
(45) Date of Patent: Nov. 14, 2023

(54) DISPLAY DEVICE AND METHOD OF DRIVING THE SAME

(71) Applicant: SAMSUNG DISPLAY CO., LTD., Yongin-si (KR)

(72) Inventors: Kihyun Pyun, Gwangmyeong-si (KR); Jang-Hoon Kwak, Cheonan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 18/148,076

(22) Filed: Dec. 29, 2022

(30) Foreign Application Priority Data

May 9, 2022 (KR) ..... 10-2022-0056824

(51) Int. Cl.
*G09G 3/20* (2006.01)
*G09G 5/10* (2006.01)
*G09G 3/3225* (2016.01)

(52) U.S. Cl.
CPC ..... *G09G 3/3225* (2013.01); *G09G 2310/08* (2013.01); *G09G 2320/0673* (2013.01); *G09G 2330/021* (2013.01); *G09G 2360/16* (2013.01)

(58) Field of Classification Search
CPC .. G09G 5/00; G09G 5/02; G09G 5/10; G09G 3/00; G09G 3/20; G09G 3/30; G09G 3/32; G09G 3/34; G09G 3/36; G09G 3/3258; G09G 3/3275; G09G 3/3208; G09G 3/3291; G09G 3/3225; G09G 3/3233; G09G 2310/08; G09G 2320/0673; G09G 2330/021; G09G 2360/16; G02F 1/1333; G02F 1/1337; G02F 1/1343; G06F 3/038
See application file for complete search history.

(56) References Cited

U.S. PATENT DOCUMENTS

2009/0189924 A1* 7/2009 Ogura ..... G09G 3/3233 345/690
2014/0354703 A1* 12/2014 Han ..... G09G 3/3233 345/83
2015/0262532 A1* 9/2015 Lim ..... G09G 3/3233 345/77
2016/0155382 A1* 6/2016 Cheon ..... G09G 3/3258 345/76

(Continued)

FOREIGN PATENT DOCUMENTS

KR 10-0590271 6/2006
KR 10-1142637 4/2012

(Continued)

*Primary Examiner* — Chanh D Nguyen
*Assistant Examiner* — Nguyen H Truong
(74) *Attorney, Agent, or Firm* — F. Chau & Associates, LLC

(57) ABSTRACT

A display device and driving method may include a display panel, a voltage curve controller generating compensated voltage curves including a first compensated voltage curve having a second point with respect to a maximum grayscale and a fourth point with respect to an intermediate grayscale generated by normalizing a first point and a third point of a first reference voltage curve with respect to a peak white grayscale and a full white grayscale based on an entire grayscale, and a driving voltage controller generating a driving voltage from the compensated voltage curves based on a load of the input image data and a maximum grayscale value of the input image data.

20 Claims, 10 Drawing Sheets

(56) References Cited

U.S. PATENT DOCUMENTS

2016/0155388 A1* 6/2016 Baik ..... G09G 5/10
345/691

FOREIGN PATENT DOCUMENTS

| | | |
|---|---|---|
| KR | 10-1883925 | 7/2018 |
| KR | 10-2020-0078023 | 7/2020 |
| KR | 10-2146107 | 8/2020 |
| KR | 10-2021-0019902 | 2/2021 |
| KR | 10-2021-0036602 | 4/2021 |
| KR | 10-2021-0083063 | 7/2021 |

* cited by examiner

DISPLAY DEVICE AND METHOD OF DRIVING THE SAME

CROSS-REFERENCE TO RELATED APPLICATION(S)

This application claims priority under 35 USC § 119 to Korean Patent Application No. 10-2022-0056824 filed on May 9, 2022 in the Korean Intellectual Property Office (KIPO), the entire disclosure of which is incorporated by reference herein.

FIELD

Embodiments of the present disclosure relate to display devices. More particularly, embodiments relate to a display device applied to various electronic apparatuses, and a method of driving the same.

DISCUSSION

A display device may include a plurality of pixels. The display device may display an image using lights emitted from the pixels.

A driving voltage may be provided to the pixels to display an image, and the pixels may emit light with luminance corresponding to driving currents flowing through the pixels. In order to reduce power consumption of the display device, the driving currents flowing through the pixels and/or the driving voltage provided to the pixels may decrease.

When the magnitude of the driving voltage provided to the pixels changes, the luminance of the image displayed by the display device may change. When the luminance of the image changes, flicker may occur, and when the flicker is recognized, image quality of the display device may be non-optimal.

SUMMARY

Embodiments of the present disclosure may provide a display device for reducing power consumption and/or improving image quality, and a method of driving the display device.

A display device according to an embodiment may include a display panel configured to display an image based on output image data into which input image data is converted, a voltage curve controller configured to calculate a peak white grayscale and a full white grayscale based on a scale factor mode set by a user, and to generate compensated voltage curves including a first compensated voltage curve having a second point with respect to a maximum grayscale and a fourth point with respect to an intermediate grayscale generated by normalizing a first point and a third point of a first reference voltage curve with respect to the peak white grayscale and the full white grayscale based on an entire grayscale, and a driving voltage controller configured to generate a driving voltage from the compensated voltage curves based on a load of the input image data and a maximum grayscale value of the input image data, and to provide the driving voltage to the display panel.

In an embodiment, the second point and the fourth point of the first compensated voltage curve may respectively correspond to the first point and the third point of the first reference voltage curve, and the first compensated voltage curve may have a maximum voltage at the second point, and may have a minimum voltage at the fourth point.

In an embodiment, a voltage of the second point may be equal to a voltage of the first point, and a voltage of the fourth point may be equal to a voltage of the third point.

In an embodiment, the first compensated voltage curve may further include a fifth point with respect to a minimum grayscale, and a voltage of the fifth point may be equal to the voltage of the second point.

In an embodiment, the voltage of the first compensated voltage curve may linearly decrease from the fifth point to the fourth point, and may linearly increase from the fourth point to the second point.

In an embodiment, the minimum grayscale and the maximum grayscale may be respectively 0 grayscale and 255 grayscale.

In an embodiment, the first compensated voltage curve may indicate a voltage with respect to a grayscale when the load of the input image data is a minimum load.

In an embodiment, the compensated voltage curves may further include a second compensated voltage curve indicating a voltage with respect to a grayscale when the load of the input image data is a maximum load, and the voltage curve controller may generate the second compensated voltage curve based on the first compensated voltage curve.

In an embodiment, the second compensated voltage curve may include a sixth point with respect to the maximum grayscale and a seventh point with respect to the intermediate grayscale. A voltage of the sixth point may be greater than the voltage of the second point by a voltage drop amount of the driving voltage corresponding to a peak white luminance calculated based on the peak white grayscale. A voltage of the seventh point may be greater than the voltage of the fourth point by a voltage drop amount of the driving voltage corresponding to a full white luminance calculated based on the full white grayscale.

In an embodiment, the voltage curve controller may include a scale factor determiner configured to determine a maximum scale factor and a minimum scale factor of a scale factor curve selected based on the scale factor mode, a luminance calculator configured to respectively convert the maximum scale factor and the minimum scale factor into a peak white luminance and a full white luminance using a peak luminance, a grayscale calculator configured to respectively convert the peak white luminance and the full white luminance into the peak white grayscale and the full white grayscale using the peak luminance and a gamma value, and a voltage curve generator configured to generate the compensated voltage curves based on the peak white grayscale, the full white grayscale, and the first reference voltage curve.

In an embodiment, the peak white luminance may be calculated by multiplying the peak luminance by the maximum scale factor, and the full white luminance may be calculated by multiplying the peak luminance by the minimum scale factor.

In an embodiment, the peak white grayscale may be calculated by applying the gamma value to a ratio of the peak white luminance to the peak luminance, and the full white grayscale may be calculated by applying the gamma value to a ratio of the full white luminance to the peak luminance.

In an embodiment, the driving voltage controller may include a load calculator configured to calculate the load of the input image data, a maximum grayscale calculator configured to calculate the maximum grayscale value of the input image data, and a driving voltage generator configured to generate the driving voltage from the compensated voltage curves based on the load of the input image data and the maximum grayscale value of the input image data.

In an embodiment, the display device may further include a power controller configured to calculate the load of the input image data, and to calculate a scale factor from a scale factor curve selected based on the scale factor mode according to the load of the input image data, and a timing controller configured to convert the input image data into the output image data using the scale factor.

A method of driving a display device according to an embodiment may include calculating a peak white grayscale and a full white grayscale based on a scale factor mode set by a user, generating compensated voltage curves including a first compensated voltage curve having a second point with respect to a maximum grayscale and a fourth point with respect to an intermediate grayscale generated by normalizing a first point and a third point of a first reference voltage curve with respect to the peak white grayscale and the full white grayscale based on an entire grayscale, and generating a driving voltage from the compensated voltage curves based on a load of the input image data and a maximum grayscale value of the input image data.

In an embodiment, the second point and the fourth point of the first compensated voltage curve may respectively correspond to the first point and the third point of the first reference voltage curve, and the first compensated voltage curve may have a maximum voltage at the second point, and may have a minimum voltage at the fourth point.

In an embodiment, a voltage of the second point may be equal to a voltage of the first point, and a voltage of the fourth point may be equal to a voltage of the third point.

In an embodiment, the first compensated voltage curve may further include a fifth point with respect to a minimum grayscale, and a voltage of the fifth point may be equal to the voltage of the second point.

In an embodiment, the voltage of the first compensated voltage curve may linearly decrease from the fifth point to the fourth point, and may linearly increase from the fourth point to the second point.

In an embodiment, calculating the peak white grayscale and the full white grayscale based on the scale factor mode may include determining a maximum scale factor and a minimum scale factor of a scale factor curve selected based on the scale factor mode, respectively converting the maximum scale factor and the minimum scale factor into a peak white luminance and a full white luminance using a peak luminance, respectively converting the peak white luminance and the full white luminance into the peak white grayscale and the full white grayscale using the peak luminance and a gamma value.

In the display device and the method of driving the display device according to embodiments, the driving voltage may be generated from the compensated voltage curves generated based on the scale factor mode set by the user, so that the driving voltage may decrease, and the change in driving voltage due to the change in input image may decrease. Accordingly, power consumption of the display device may be reduced, and image quality of the display device may be optimized.

BRIEF DESCRIPTION OF THE DRAWINGS

Illustrative, non-limiting embodiments will be more clearly understood from the following detailed description taken in conjunction with the accompanying drawings.

DETAILED DESCRIPTION

Hereinafter, a display device and a method of driving a display device according to embodiments of the present disclosure will be described in more detail with reference to the accompanying drawings. The same or similar reference indicia may be used for the same or similar elements in the accompanying drawings.

Figure 1:
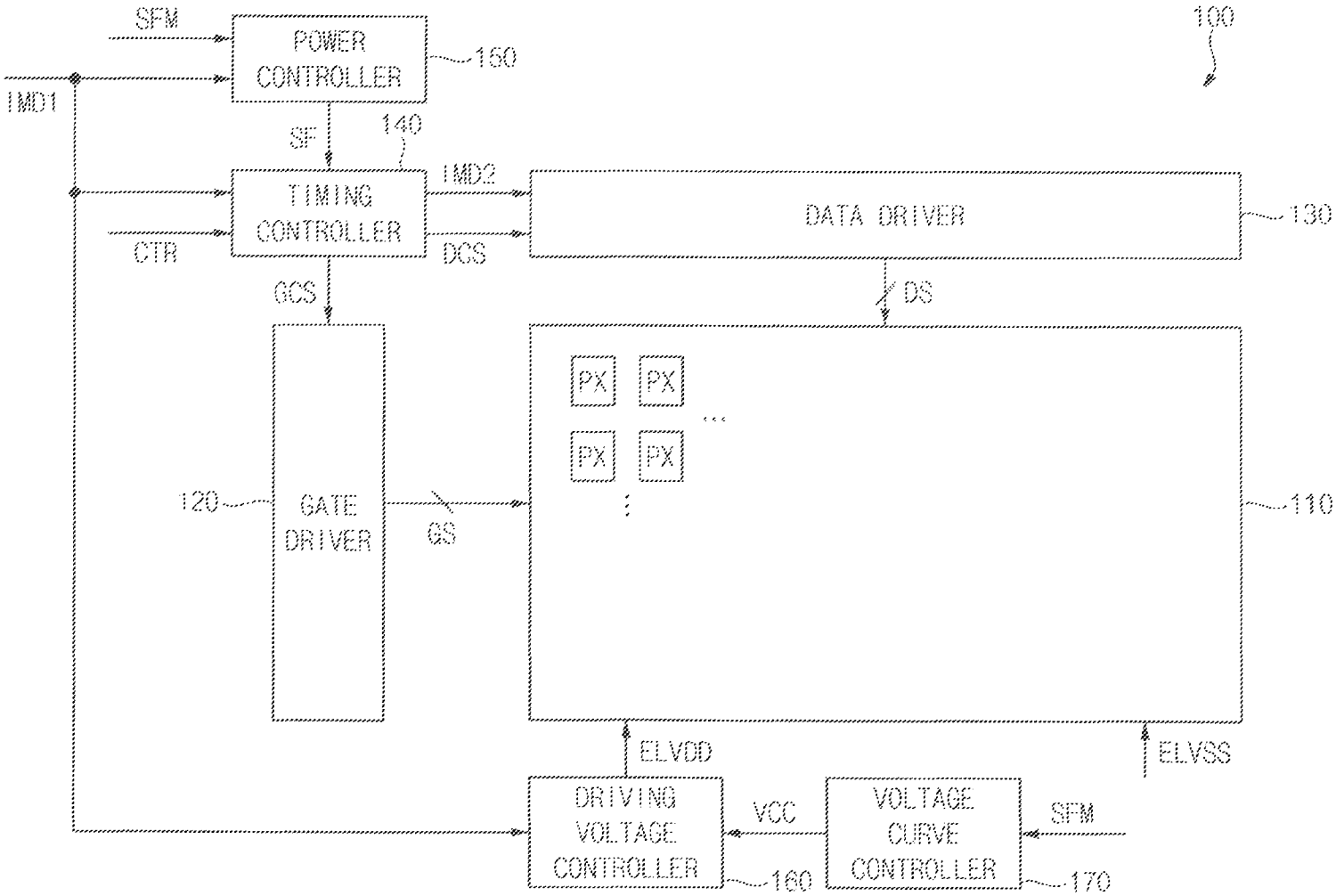
FIG. 1 is a block diagram illustrating a display device according to an embodiment.

FIG. 1 illustrates a display device 100 according to an embodiment.

Referring to FIG. 1, the display device 100 may include a display panel 110, a gate driver 120, a data driver 130, a timing controller 140, a power controller 150, a driving voltage controller 160, and a voltage curve controller 170.

The display panel 110 may display an image based on output image data IMD2. The display panel 110 may include various display elements such as organic light-emitting diodes ("OLED") or the like. Hereinafter, the display panel 110 including organic light-emitting diodes as display elements may be described for convenience. However, the present disclosure is not limited thereto, and the display panel 110 may include various display elements such as liquid crystal display ("LCD") elements, electrophoretic display ("EPD") elements, inorganic light-emitting diodes, quantum dot light-emitting diodes, or the like. The display panel 110 may include a plurality of pixels PX.

Figure 2:
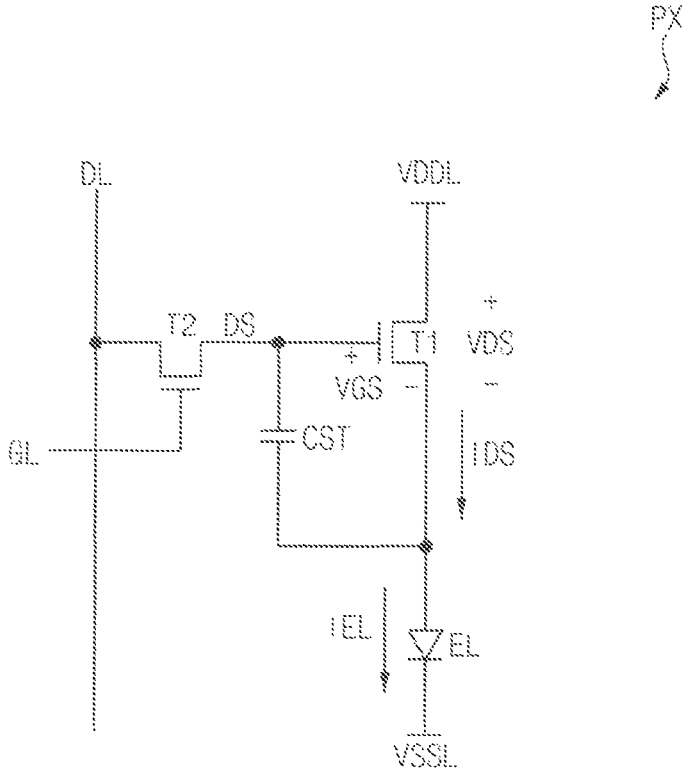
FIG. 2 is a circuit diagram illustrating a pixel included in the display device of FIG. 1.

FIG. 2 illustrates a representative pixel PX included in the display device 100 of FIG. 1. As shown in FIG. 2, each of the pixels PX may be electrically connected to a data line DL and a gate line GL. Further, each of the pixels PX may be electrically connected to a driving voltage line VDDL and a common voltage line VSSL, and may receive a driving voltage ELVDD and a common voltage ELVSS from the driving voltage line VDDL and the common voltage line VSSL, respectively. Each of the pixels PX may emit light with a luminance corresponding to a data signal DS provided through the data line DL in response to a gate signal GS provided through the gate line GL.

The gate driver 120 may generate the gate signals GS based on a gate control signal GCS received from the timing controller 140, and may provide the gate signals GS to the display panel 110. The gate control signal GCS may include a gate start signal, a gate clock signal, or the like. The gate driver 120 may sequentially generate the gate signals GS corresponding to the gate start signal based on the gate clock signal GCS.

The data driver 130 may generate the data signals DS based on the output image data IMD2 and a data control signal DCS received from the timing controller 140, and may provide the data signals DS to the display panel 110. The output image data IMD2 may include grayscale values respectively corresponding to the pixels PX. The data control signal DCS may include a data start signal, a data clock signal, or the like.

The timing controller 140 may control a driving of the gate driver 120 and a driving of the data driver 130. The timing controller 140 may generate the output image data IMD2, the gate control signal GCS, and the data control signal DCS based on input image data IMD1, a scale factor SF received from the power controller 150, and a control signal CTR. The input image data IMD1 may include grayscale values respectively corresponding to the pixels PX. The control signal CTR may include a vertical synchronization signal, a horizontal synchronization signal, a clock signal, a data enable signal, or the like.

The timing controller 140 may convert the input image data IMD1 into the output image data IMD2 using the scale factor SF. In an embodiment, the timing controller 140 may generate the output image data IMD2 by scaling the grayscale values included in the input image data IMD1 using the scale factor SF.

The power controller 150 may calculate a load of the input image data IMD1, and may calculate the scale factor SF from a scale factor curve selected based on a scale factor mode SFM according to the load of the input image data IMD1. The power controller 150 may provide the scale factor SF to the timing controller 140. The power controller 150 may be described with reference to FIGS. 3 through 6.

The driving voltage controller 160 may generate the driving voltage ELVDD from compensated voltage curves VCC based on the load of the input image data IMD1 and a maximum grayscale value of the input image data IMD1, and may provide the driving voltage ELVDD to the display panel 110. The driving voltage controller 160 may be described in greater detail with reference to FIG. 7.

The voltage curve controller 170 may generate the compensated voltage curves VCC based on the scale factor mode SFM, and may provide the compensated voltage curves VCC to the driving voltage controller 160. The voltage curve controller 170 may be described in greater detail with reference to FIGS. 12 and 13.

Referring again to FIG. 2, the pixel PX may include a first transistor T1, a second transistor T2, a storage capacitor CST, and a light-emitting element EL.

The first transistor T1 may provide a driving current IEL to the light-emitting element EL. A first electrode of the first transistor T1 may be connected to the driving voltage line VDDL for the driving voltage ELVDD, and a second electrode of the first transistor T1 may be connected to a first electrode of the light-emitting element EL. A gate electrode of the first transistor T1 may be connected to a second electrode of the second transistor T2.

The second transistor T2 may provide the data signal DS to the first transistor T1. A first electrode of the second transistor T2 may be connected to the data line DL, and the second electrode of the second transistor T2 may be connected to the gate electrode of the first transistor T1. A gate electrode of the second transistor T2 may be connected to the gate line GL.

FIG. 2 illustrates an embodiment in which each of the first transistor T1 and the second transistor T2 is an N-type transistor, but the present disclosure is not limited thereto. In an embodiment, at least one of the first transistor T1 and the second transistor T2 may be a P-type transistor.

The storage capacitor CST may store the data signal DS. A first electrode of the storage capacitor CST may be connected to the second electrode of the first transistor T1, and a second electrode of the storage capacitor CST may be connected to the second electrode of the second transistor T2 and the gate electrode of the first transistor T1.

FIG. 2 illustrates an embodiment in which the pixel PX includes two transistors T1 and T2 and one capacitor CST, but the present disclosure is not limited thereto. In an embodiment, the pixel PX may include three or more transistors and/or two or more capacitors.

The light-emitting element EL may emit light based on the driving current IEL. The first electrode of the light-emitting element EL may be connected to the second electrode of the first transistor T1, and a second electrode of the light-emitting element EL may be connected to the common voltage line VSSL for the common voltage ELVSS.

When the first transistor T1 operates in a saturation region, a voltage VDS between the first electrode and the second electrode of the first transistor T1 may be proportional to a current IDS flowing through the first transistor T1. The voltage VDS between the first electrode and the second electrode of the first transistor T1 may be equal to a difference between the driving voltage ELVDD and a voltage of the first electrode of the light-emitting element EL, and the current IDS flowing through the first transistor T1 may be equal to the driving current IEL. Accordingly, although a voltage VGS between the gate electrode and the second electrode of the first transistor T1 remains, the luminance of the pixel PX may increase as the driving current IEL increases when the driving voltage ELVDD increases, and the luminance of the pixel PX may decrease as the driving current IEL decreases when the driving voltage ELVDD decreases, for example.

Figure 3:
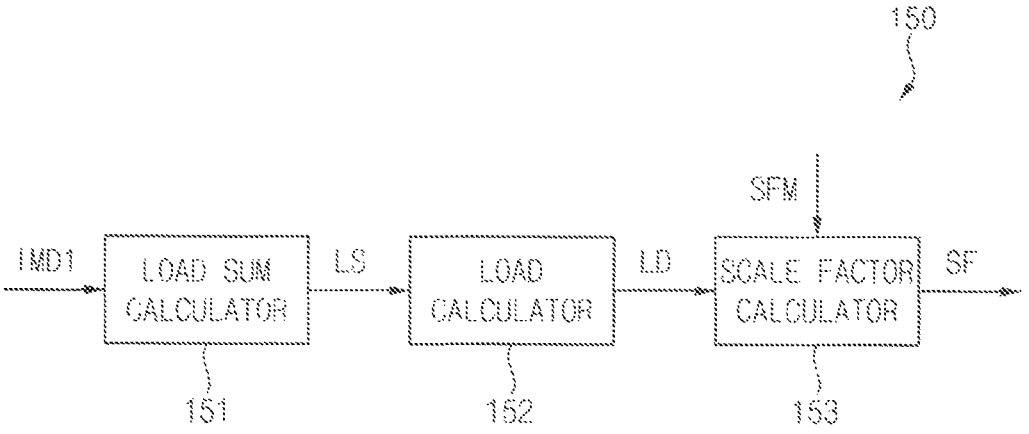
FIG. 3 is a block diagram illustrating a power controller included in the display device of FIG. 1.

FIG. 3 illustrates the power controller 150 included in the display device 100 of FIG. 1.

Referring to FIG. 3, the power controller 150 may include a load sum calculator 151, a load calculator 152, and a scale factor calculator 153.

The load sum calculator 151 may calculate a load sum LS of the input image data IMD1 from the input image data IMD1. The load sum LS of the input image data IMD1 may be an average of the grayscale values included in the input image data IMD1. In an embodiment, when the input image data IMD1 represents a grayscale using 8 bits, a minimum grayscale may be 0 grayscale, and a maximum grayscale may be 255 grayscale.

The load calculator 152 may calculate the load LD of the input image data IMD1 from the load sum LS of the input image data IMD1. The load LD of the input image data IMD1 may be a ratio of the load sum LS of the input image data IMD1 to a maximum load. In an embodiment, the load LD of the input image data IMD1 may be 0% when the input image corresponding to the input image data IMD1 is a full black image, and the load LD of the input image data IMD1 may be 100% when the input image corresponding to the input image data IMD1 is a full white image.

The scale factor calculator 153 may calculate the scale factor SF from the scale factor curve selected based on the scale factor mode SFM according to the load LD of the input image data IMD1.

Figure 4:
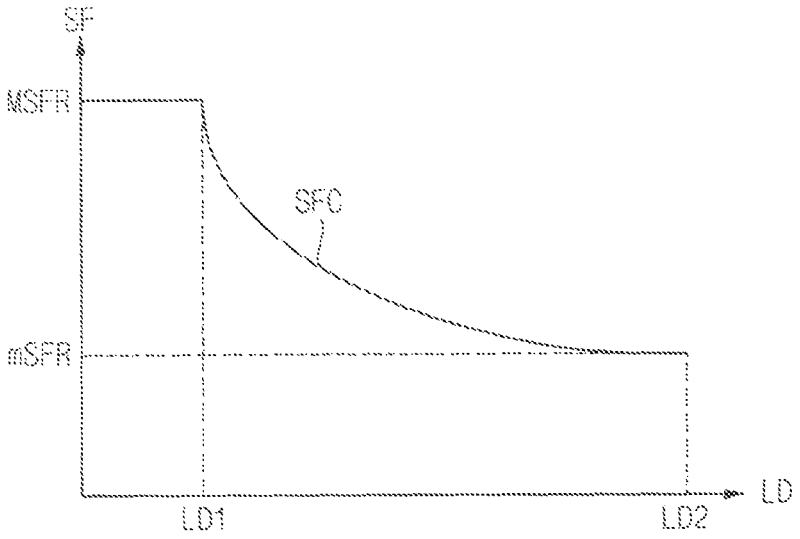
FIG. 4 is a graphical diagram illustrating a reference scale factor curve.

FIG. 4 illustrates a reference scale factor curve SFC.

Referring to FIG. 4, the reference scale factor curve SFC may represent the scale factor SF with respect to the load LD of the input image data IMD1. The scale factor SF of the reference scale factor curve SFC may have a maximum reference scale factor MSFR between a minimum load and a first load LD1, and a minimum reference scale factor mSFR at the second load LD2. The scale factor SF of the reference scale factor curve SFC may decrease from the maximum reference scale factor MSFR to the minimum reference scale factor mSFR for loads between the first load LD1 and the second load LD2. In an embodiment, the first load LD1 and the second load LD2 may be 20% and 100%, respectively, and the maximum reference scale factor MSFR and the minimum reference scale factor mSFR may be 1.0 and 0.2, respectively.

Figure 5:
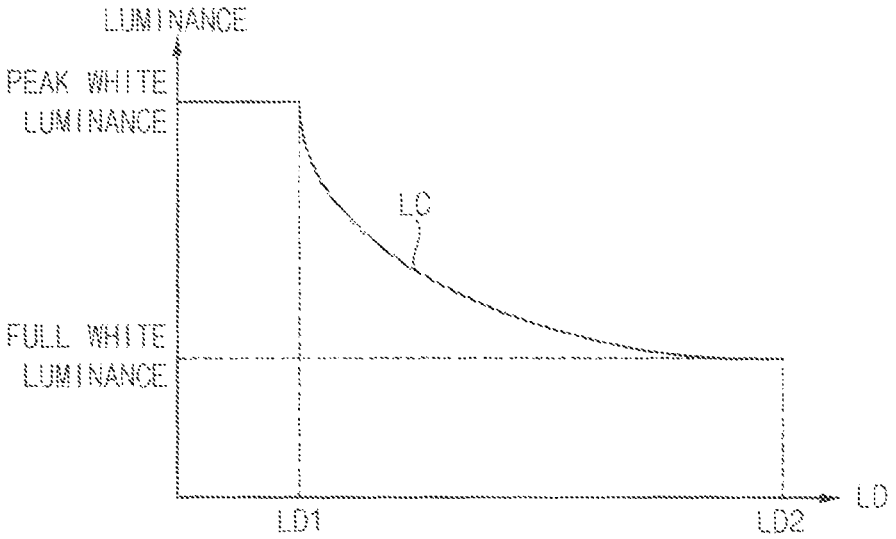
FIG. 5 is a graphical diagram illustrating a reference luminance curve.

FIG. 5 illustrates a reference luminance curve LC. The reference luminance curve LC of FIG. 5 may correspond to the reference scale factor curve SFC of FIG. 4.

Referring to FIG. 5, when the reference scale factor curve SFC is selected based on the scale factor mode SFM, the timing controller 140 may convert the input image data IMD1 into the output image data IMD2 by using the scale factor SF calculated from the reference scale factor curve SFC. The reference luminance curve LC may indicate a luminance of an output image corresponding to the output image data IMD2 with respect to the load LD of the input image data IMD1. The luminance of the reference luminance curve LC may have a peak white luminance between the minimum load and the first load LD1, and may have a full white luminance at the second load LD2. The peak white luminance may represent a luminance of a partial region of an output image corresponding to the output image data IMD2 when the load LD of the input image data IMD1 corresponding to an input image in which a partial region is a white image is less than or equal to the first load LD1. The full white luminance may represent a luminance of an output image corresponding to the output image data IMD2 when the load LD of the input image data IMD1 corresponding to an input image that is the full white image is the second load LD2.

The power controller 150 may provide the scale factor SF to the timing controller 140, and the timing controller 140 may scale grayscale values of the image data using the scale factor SF, so that the driving currents IEL flowing through the pixels PX may decrease, for example. Accordingly, power consumption of the display device 100, which is proportional to the sum of the driving currents IEL flowing through the pixels PX and the driving voltage ELVDD, may be reduced.

Figure 6:
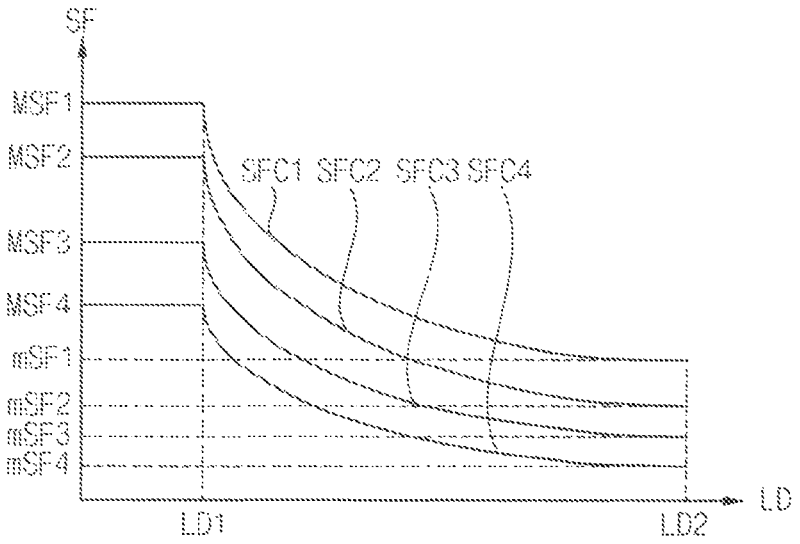
FIG. 6 is a graphical diagram illustrating scale factor curves according to an embodiment.

FIG. 6 illustrates scale factor curves SFC1, SFC2, SFC3, and SFC4 according to an embodiment.

Referring to FIG. 6, one scale factor curve may be selected from a plurality of scale factor curves SFC1, SFC2, SFC3, and SFC4 based on the scale factor mode SFM. The scale factor mode SFM may be set by the user, without limitation thereto. In an embodiment, the scale factor curves SFC1, SFC2, SFC3, and SFC4 may include first to fourth scale factor curves SFC1, SFC2, SFC3, and SFC4. Each of the first to fourth scale factor curves SFC1, SFC2, SFC3, and SFC4 may represent a scale factor SF with respect to a load LD of the input image data IMD1.

The first scale factor curve SFC1 may have a first maximum scale factor MSF1 for loads between the minimum load and the first load LD1, and the first scale factor curve SFC1 may decrease from the maximum scale factor MSF1 to a first minimum scale factor mSF1 for loads between the first load LD1 and the second load LD2. In an embodiment, the first maximum scale factor MSF1 and the first minimum scale factor mSF1 may be 1.0 and 0.2, respectively. In such an embodiment, the first scale factor curve SFC1 may be the same as the reference scale factor curve SFC. In an embodiment, the first maximum scale factor MSF1 and the first minimum scale factor mSF1 may be 1.0 and 0.4, respectively. The second scale factor curve SFC2 may have a second maximum scale factor MSF2 for loads between the minimum load and the first load LD1, and the second scale factor curve SFC2 may decrease from the maximum scale factor MSF2 to a second minimum scale factor mSF2 for loads between the first load LD1 and the second load LD2. The second maximum scale factor MSF2 and the second minimum scale factor mSF2 may be smaller than the first maximum scale factor MSF1 and the first minimum scale factor mSF1, respectively. In an embodiment, the second maximum scale factor MSF2 and the second minimum scale factor mSF2 may be 0.8 and 0.15, respectively. In an embodiment, the second maximum scale factor MSF2 and the second minimum scale factor mSF2 may be 0.9 and 0.3, respectively.

The third scale factor curve SFC3 may have a third maximum scale factor MSF3 for loads between the minimum load and the first load LD1, and the third scale factor curve SFC3 may decrease from the maximum scale factor MSF3 to a third minimum scale factor mSF3 for loads between the first load LD1 and the second load LD2. The third maximum scale factor MSF3 and the third minimum scale factor mSF3 may be smaller than the second maximum scale factor MSF2 and the second minimum scale factor mSF2, respectively. In an embodiment, the third maximum scale factor MSF3 and the third minimum scale factor mSF3 may be 0.5 and 0.1, respectively. In an embodiment, the third maximum scale factor MSF3 and the third minimum scale factor mSF3 may be 0.8 and 0.2, respectively. The fourth scale factor curve SFC4 may have a fourth maximum scale factor MSF4 for loads between the minimum load and the first load LD1, and the fourth scale factor curve SFC4 may decrease from the maximum scale factor MSF4 to a fourth minimum scale factor mSF4 for loads between the first load LD1 and the second load LD2. The fourth maximum scale factor MSF4 and the fourth minimum scale factor mSF4 may be smaller than the third maximum scale factor MSF3 and the third minimum scale factor mSF3, respectively. In an embodiment, the fourth maximum scale factor MSF4 and the fourth minimum scale factor mSF4 may be 0.3 and 0.05, respectively. In an embodiment, the fourth maximum scale factor MSF4 and the fourth minimum scale factor mSF4 may be 0.7 and 0.1, respectively.

The power controller 150 may calculate the scale factor SF by selecting one scale factor curve among the first to fourth scale factor curves SFC1, SFC2, SFC3, and SFC4 based on the scale factor mode SFM, so that the luminance of the output image corresponding to the output image data IMD2 may be controlled. For example, a scale factor mode SFM corresponding to the first scale factor curve SFC1 may be set to display an output image with high luminance, and a scale factor mode SFM corresponding to the fourth scale factor curve SFC4 may be set to reduce power consumption of the display device 100.

Figure 7:
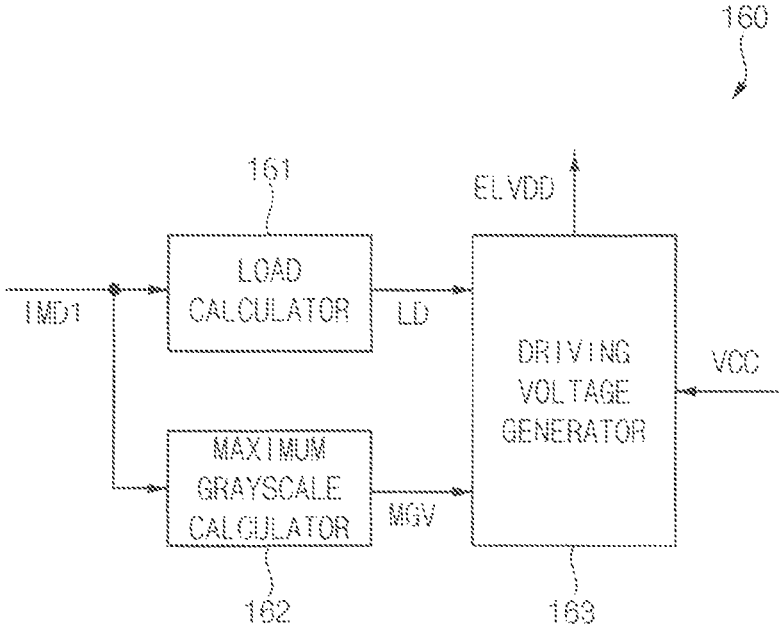
FIG. 7 is a block diagram illustrating a driving voltage controller included in the display device of FIG. 1.

FIG. 7 illustrates the driving voltage controller 160 included in the display device 100 of FIG. 1.

Referring to FIG. 7, the driving voltage controller 160 may include a load calculator 161, a maximum grayscale calculator 162, and a driving voltage generator 163.

The load calculator 161 may calculate the load LD of the input image data IMD1 from the input image data IMD1.

The maximum grayscale calculator 162 may calculate the maximum grayscale value MGV of the input image data IMD1 from the input image data IMD1. The maximum grayscale value MGV of the input image data IMD1 may be the highest grayscale value among the grayscale values included in the input image data IMD1.

The driving voltage generator 163 may generate the driving voltage ELVDD from the compensated voltage curves VCC based on the load LD of the input image data IMD1 and the maximum grayscale value MGV of the input image data IMD1. Each of the compensated voltage curves VCC may represent a voltage with respect to a grayscale. One compensated voltage curve may be selected from the compensated voltage curves VCC based on the load LD of the input image data IMD1, and one point may be selected from points of the selected compensated voltage curve based on the maximum grayscale value MGV of the input image data IMD1. The driving voltage generator 163 may determine a voltage corresponding to the selected point as the driving voltage ELVDD, and may provide the determined driving voltage ELVDD to the display panel 110.

The voltage curve controller 170 may provide the compensated voltage curves VCC to the driving voltage controller 160, and the driving voltage controller 160 may generate the driving voltage ELVDD from the compensated voltage curves VCC based on the input image data IMD1, so that the driving voltage ELVDD may be adjusted in consideration of the load LD and the maximum grayscale value MGV of the input image data IMD1. Accordingly, the driving voltage ELVDD provided to the pixels PX may decrease, and power consumption of the display device 100, which is proportional to the sum of the driving currents IEL flowing through the pixels PX and the driving voltage ELVDD, may be reduced.

Figure 8:
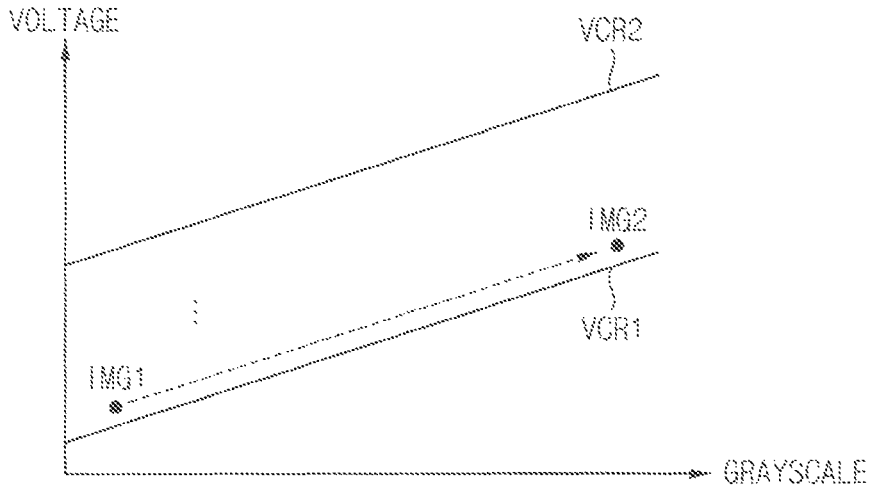
FIG. 8 is a graphical diagram illustrating reference voltage curves according to an embodiment.

FIG. 8 illustrates reference voltage curves VCR1, . . . , VCR2 according to an embodiment.

Referring to FIG. 8, each of the reference voltage curves VCR1, . . . , VCR2 according to an embodiment may represent a voltage with respect to a grayscale. The reference voltage curves VCR1, . . . , VCR2 may include a first reference voltage curve VCR1, a second reference voltage curve VCR2, or the like. The first reference voltage curve VCR1 may represent a voltage with respect to a grayscale when the load of image data is the minimum load (e.g., 0%). The second reference voltage curve VCR2 may represent a voltage with respect to a grayscale when the load of image data is the maximum load (e.g., 100%). In addition, the reference voltage curves VCR1, . . . , VCR2 may further include additional reference voltage curves VCRi between the first reference voltage curve VCR1 and the second reference voltage curve VCR2. Each of the additional reference voltage curves VCRi may represent a voltage with respect to a grayscale when the load of image data is greater than the minimum load and less than the maximum load.

Since a voltage drop amount of the driving voltage ELVDD, across at least the first and second electrodes of the first transistor T1 in a saturation mode, increases as the load of image data increases, the voltage of the reference voltage curve may increase as the load of image data increases. Further, since a luminance of the pixel PX, to which the data signal DS corresponding to the maximum grayscale value is applied, increases as the maximum grayscale value of the image data increases, the voltage of each of the reference voltage curves VCR1, . . . , VCR2 may linearly increase from the minimum grayscale to the maximum grayscale.

Figure 9:
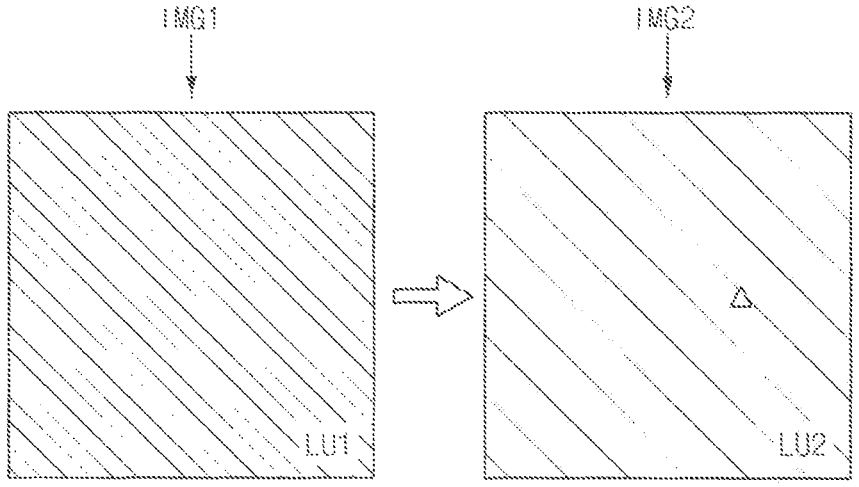
FIG. 9 is a block diagram for describing a change in luminance due to a change in image according to a comparative example.

FIG. 9 is used for describing a change in luminance due to a change in image according to a comparative example.

Referring to FIGS. 8 and 9, in a comparative example of the present disclosure, a driving voltage controller may generate a driving voltage ELVDD from the reference voltage curves VCR1, . . . , VCR2 based on the load and the maximum grayscale value of the output image data IMD2. When a first image IMG1 is displayed in a first frame period and a second image IMG2 is displayed in a second frame period after the first frame period, the driving voltage controller may generate the driving voltage ELVDD in the first and second frame periods from the reference voltage curves VCR1, . . . , VCR2 based on the loads and maximum grayscale values of the output image data IMD2 corresponding to the first and second images IMG1 and IMG2, respectively. For example, the first image IMG1 may be a background image of 16 grayscale, and the second image IMG2 may be an image in which a small triangle of 255 grayscale is displayed on a background of 16 grayscale.

Since the load of the output image data IMD2 corresponding to the first image IMG1 and the load of the output image data IMD2 corresponding to the second image IMG2 are relatively small, a reference voltage curve VCRi adjacent to the first reference voltage curve VCR1 may be selected from the reference voltage curves VCR1, . . . , VCR2. Further, since the maximum grayscale value of the output image data IMD2 corresponding to the first image IMG1 is 16 grayscale and the maximum grayscale value of the output image data IMD2 corresponding to the second image IMG2 is 255 grayscale, the driving voltage ELVDD generated in the second frame period displaying the second image IMG2 may be greater than the driving voltage ELVDD generated in the first frame period displaying the first image IMG1. In this case, since the driving voltages ELVDD provided to the pixel PX are different although the data signal DS provided to the pixel PX is the same in the first and second frame periods, a second luminance LU2 of the background of the second image IMG2 may be higher than a first luminance LU1 of the background of the first image IMG1. In particular, a voltage VDS between the first electrode and the second electrode of the first transistor T1 may increase as the driving voltage ELVDD increases in the first and second frame periods, and a current IDS flowing through the first transistor T1 may increase due to channel length modulation characteristics when the voltage VDS between the first electrode and the second electrode of T1 increases although the voltages VGS between the gate electrode and the second electrode of the first transistor T1 are the same. As the current IDS flowing through the first transistor T1 increases, the first luminance LU1 of the background of the first image IMG1 may increase to the second luminance LU2 of the background of the second image IMG2, for example. An increase in background luminance (LU1→LU2) due to the change in image (IMG1→IMG2) may be recognized as a flicker, and if so, the image quality of the display device 100 may be non-optimal.

Figure 10:
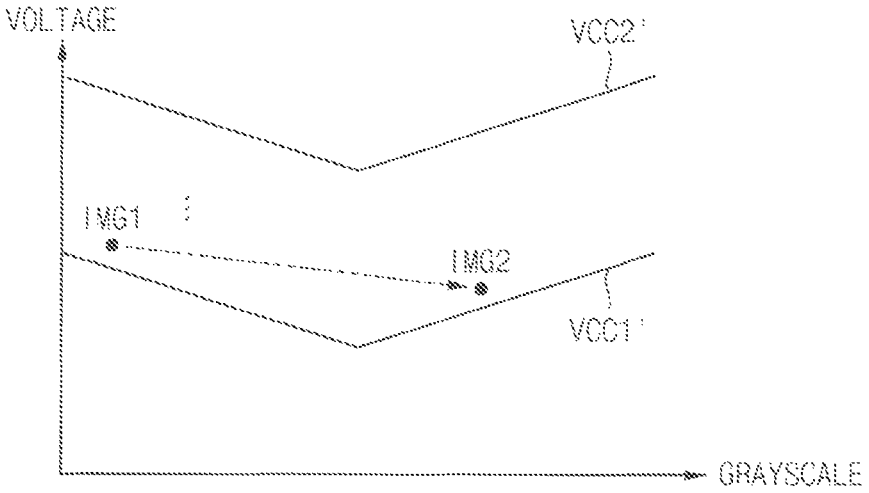
FIG. 10 is a graphical diagram illustrating compensated voltage curves according to a comparative example.

FIG. 10 illustrates compensated voltage curves VCC1', . . . , VCC2' according to a comparative example.

Referring to FIG. 10, each of the compensated voltage curves VCC1', . . . , VCC2' according to a comparative example may represent a voltage with respect to a grayscale. The compensated voltage curves VCC1', . . . , VCC2' may include a first compensated voltage curve VCC1', a second compensated voltage curve VCC2', or the like. The first compensated voltage curve VCC1' may represent a voltage with respect to a grayscale when the load of image data is the minimum load (e.g., 0%). The second compensated voltage curve VCC2' may represent a voltage with respect to a grayscale when the load of image data is the maximum load (e.g., 100%). In addition, the compensated voltage curves VCC1', . . . , VCC2' may further include additional compensated voltage curves VCCi' between the first compensated voltage curve VCC1' and the second compensated voltage curve VCC2'. Each of the additional compensated voltage curves VCCi' may represent a voltage with respect to a grayscale when the load of image data is greater than the minimum load and less than the maximum load.

Since a voltage drop amount of the driving voltage ELVDD, across at least the first and second electrodes of the first transistor T1 in a saturation mode, increases as the load of image data increases, a voltage of the compensated voltage curve may increase as the load of image data increases. Further, since a luminance of the pixel PX to which the data signal DS corresponding to the maximum grayscale value is applied increases as the maximum grayscale value of the image data increases, the voltage of each of the compensated voltage curves VCC1', . . . , VCC2' may linearly increase for grayscales from an intermediate grayscale to the maximum grayscale. However, in order to prevent an increase in background luminance (LU1→LU2) due to the change in image (IMG1→IMG2) described with reference to FIGS. 8 and 9, the voltage of each of the compensated voltage curves VCC1', . . . , VCC2' may linearly decrease for grayscales from the minimum grayscale to the intermediate grayscale. Accordingly, the voltage of each of the compensated voltage curves VCC1', . . . , VCC2' may linearly decrease for grayscales from the minimum grayscale to the intermediate grayscale, and may linearly increase for grayscales from the intermediate grayscale to the maximum grayscale.

Figure 11:
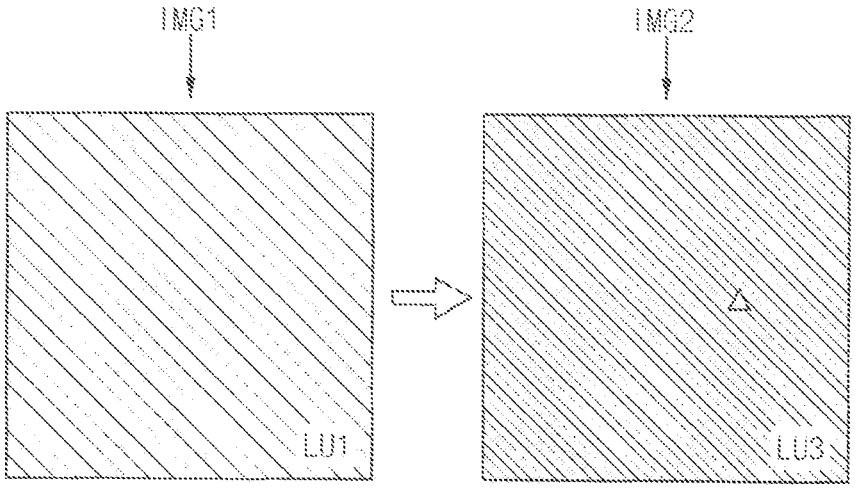
FIG. 11 is a block diagram for describing a change in luminance due to a change in image according to a comparative example.

FIG. 11 is used for describing a change in luminance due to a change in image according to a comparative example.

Referring to FIGS. 10 and 11, in a comparative example of the present disclosure, a driving voltage controller may generate a driving voltage ELVDD from the compensated voltage curves VCC1', . . . , VCC2' based on the load and the maximum grayscale value of the output image data IMD2. When a first image IMG1 is displayed in a first frame period and a second image IMG2 is displayed in a second frame period after the first frame period, the driving voltage controller may generate the driving voltage ELVDD in the first and second frame periods from the compensated voltage curves VCC1', . . . , VCC2' based on the load and maximum grayscale value of the output image data IMD2 corresponding to the first and second images IMG1 and IMG2. For example, the first image IMG1 may be a background image of 16 grayscale, and the second image IMG2 may be an image in which a small triangle of 255 grayscale is displayed on a background of 16 grayscale.

In a comparative example, the scale factor SF may be calculated based on the scale factor mode SFM, and the input image data IMD1 may be converted into the output image data IMD2 using the scale factor SF. For example, when the third scale factor curve SFC3 is selected based on the scale factor mode SFM and the third maximum scale factor MSF3 and the third minimum scale factor mSF3 are 0.5 and 0.1, respectively, the maximum grayscale value of image data corresponding to the first image IMG1 may decrease from 16 grayscale to 12 grayscale, and the maximum grayscale value of image data corresponding to the second image IMG2 may decrease from 255 grayscale to 147 grayscale. In other words, the maximum grayscale value of the output image data IMD2 corresponding to the first image IMG1 may be 12 grayscale, and the maximum grayscale value of the output image data IMD2 corresponding to the second image IMG2 may be 147 grayscale.

Since the load of the output image data IMD2 corresponding to the first image IMG1 and the load of the output image data IMD2 corresponding to the second image IMG2 are relatively small, a compensated voltage curve adjacent to the first compensated voltage curve VCC1' may be selected from the compensated voltage curves VCC1', . . . , VCC2'. Further, since the maximum grayscale value of the output image data IMD2 corresponding to the first image IMG1 is 12 grayscale and the maximum grayscale value of the output image data IMD2 corresponding to the second image IMG2 is 147 grayscale, the driving voltage ELVDD generated in the second frame period displaying the second image IMG2 may be less than the driving voltage ELVDD generated in the first frame period displaying the first image IMG1. In this case, since the driving voltages ELVDD provided to the pixel PX are different although the data signal DS provided to the pixel PX is the same in the first and second frame periods, a third luminance LU3 of the background of the second image IMG2 may be lower than a first luminance LU1 of the background of the first image IMG1. A decrease in background luminance (LU1→LU3) due to the change in image (IMG1→IMG2) may be recognized as a flicker, and accordingly, the image quality of the display device 100 may be non-optimal.

Figure 12:
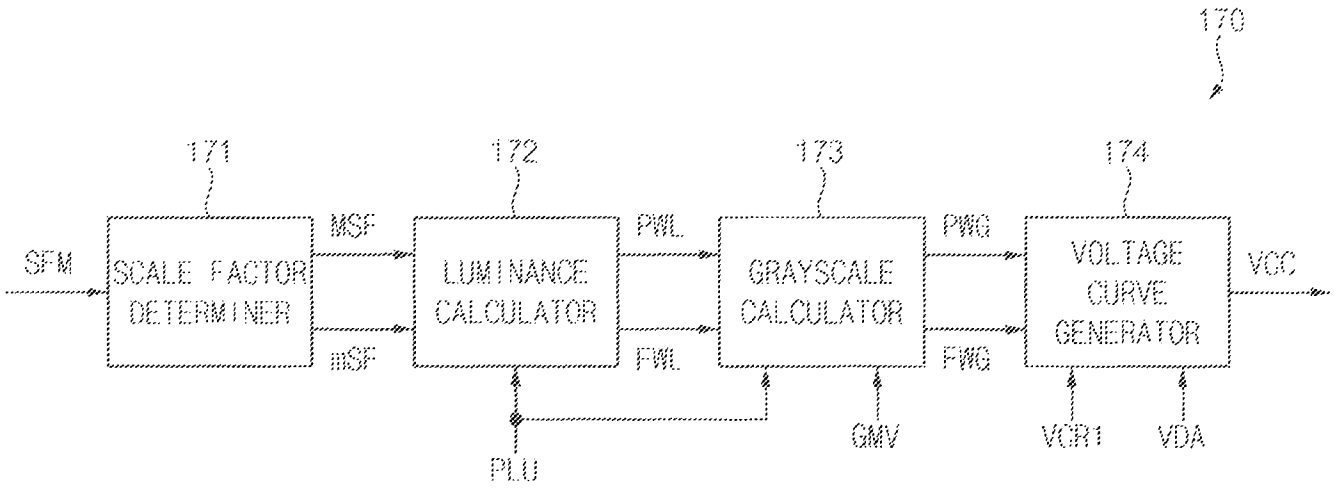
FIG. 12 is a block diagram illustrating a voltage curve controller included in the display device of FIG. 1.

FIG. 12 illustrates the voltage curve controller 170 included in the display device 100 of FIG. 1.

Referring to FIG. 12, the voltage curve controller 170 may include a scale factor determiner 171, a luminance calculator 172, a grayscale calculator 173, and a voltage curve generator 174.

The scale factor determiner 171 may determine a maximum scale factor MSF and a minimum scale factor mSF of the scale factor curve selected based on the scale factor mode SFM. For example, when the fourth scale curve SFC4 is selected based on the scale factor mode SFM, the scale factor determiner 171 may determine the maximum scale factor MSF and the minimum scale factor mSF as 0.3 and 0.05, respectively.

The luminance calculator 172 may convert the maximum scale factor MSF and the minimum scale factor mSF into a peak white luminance PWL and a full white luminance FWL using a peak luminance PLU. The peak white luminance PWL may be calculated by multiplying the peak luminance PLU by the maximum scale factor MSF, and the full white luminance FWL may be calculated by multiplying the peak luminance PLU by the minimum scale factor mSF. For example, when the peak luminance PLU is 1000 nits and the maximum scale factor MSF and the minimum scale factor mSF are 0.3 and 0.05, respectively, the luminance calculator 172 may calculate the peak white luminance PWL and the full white luminance FWL as 300 nits and 50 nits, respectively.

The grayscale calculator 173 may respectively convert the peak white luminance PWL and the full white luminance FWL into a peak white grayscale PWG and a full white grayscale FWG using the peak luminance PLU and a gamma value GMV. The peak white grayscale PWG may be calculated by multiplying the maximum grayscale (e.g., 255 grayscale) by a ratio of the peak white luminance PWL to the peak luminance PLU and applying the gamma value GMV, and the full white grayscale FWG may be calculated by multiplying the maximum grayscale by a ratio of the full white luminance FWL to the peak luminance PLU and applying the gamma value GMV. For example, when the peak luminance PLU and the gamma value GMV are 1000 nits and 2.2, respectively, and the peak white luminance PWL and full white luminance FWL are 300 nits and 50 nits, respectively, the grayscale calculator 173 may calculate the peak white grayscale PWG and the full white grayscale FWG as 147 grayscale and 66 grayscale, respectively.

The voltage curve generator 174 may generate compensated voltage curves VCC based on the peak white grayscale PWG, the full white grayscale FWG, the first reference voltage curve VCR1, and a voltage drop amount VDA.

Figure 13:
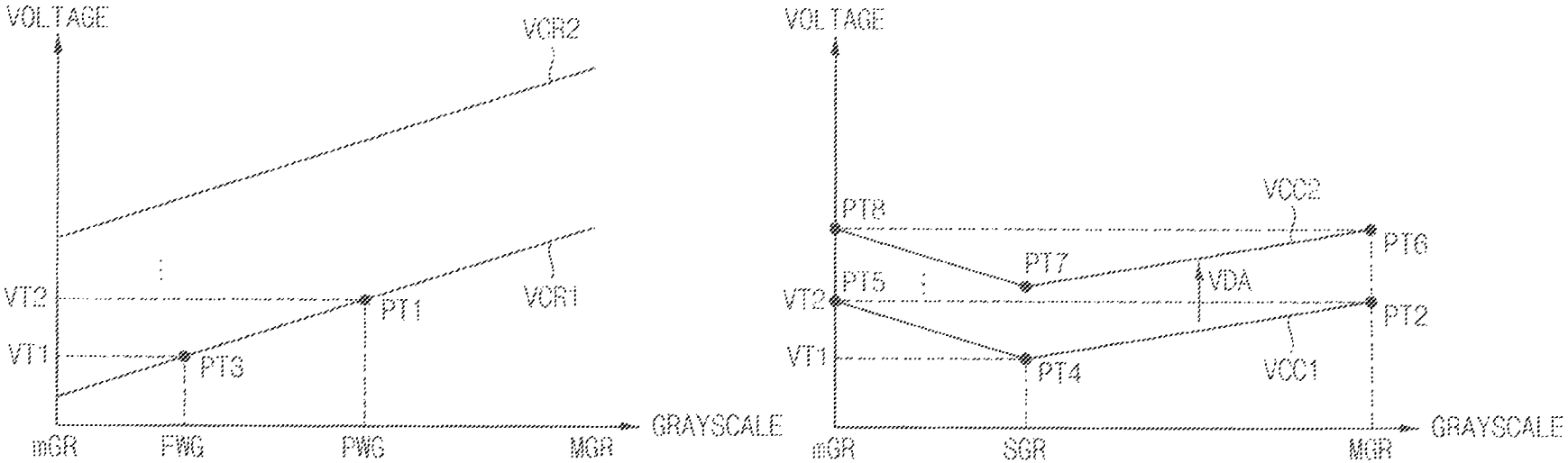
FIG. 13 is a diagram for describing a generation of compensated voltage curves according to an embodiment.

FIG. 13 is used for describing generation of compensated voltage curves VCC1, . . . , VCC2 according to an embodiment.

Referring to FIG. 13, the voltage curve generator 174 may generate a first compensated voltage curve VCC1 including a second point PT2 and a fourth point PT4 generated by normalizing a first point PT1 and a third point PT3 of the first reference voltage curve VCR1 with respect to the peak white grayscale PWG and the full white grayscale FWG based on an entire grayscale such that the first point PT1 of the first reference voltage curve VCR1 with respect to the peak white grayscale PWG corresponds to the second point PT2 of the first compensated voltage curve VCC1 with respect to a maximum grayscale MGR and the third point PT3 of the first reference voltage curve VCR1 with respect to the full white grayscale FWG corresponds to the fourth point PT4 of the first compensated voltage curve VCC1 with respect to an intermediate grayscale SGR. The reference voltage curves VCR1, . . . , VCR2 represent voltages for the minimum grayscale mGR to the maximum grayscale MGR, but since the peak white grayscale PWG is less than the maximum grayscale MGR according to the scale factor mode SFM, when the reference voltage curves VCR1, . . . , VCR2 are applied to the output image data IMD2 to generate the driving voltage ELVDD, the driving voltage ELVDD for the minimum grayscale mGR to the peak white grayscale PWG may be generated. In other words, when the reference voltage curves VCR1, VCR2 are applied to the output image data IMD2 to generate the driving voltage ELVDD, the driving voltage ELVDD for the peak white grayscale PWG to the maximum grayscale MGR need not be generated. Accordingly, in order to generate the driving voltage ELVDD for the minimum grayscale mGR to the maximum grayscale MGR, the second point PT2 and the fourth point PT4 may be determined by normalizing the first point PT1 and the third point PT3 of the first reference voltage curve VCR1 with respect to the peak white grayscale PWG and the full white grayscale FWG based on the entire grayscale, and the first compensated voltage curve VCC1 including the second point PT2 and the fourth point PT4 may be generated. For example, when the peak white grayscale PWG and the full white grayscale FWG are 147 grayscale and 66 grayscale, respectively, the second point PT2 may correspond to the maximum grayscale MGR (e.g., 255 grayscale), and the fourth point PT4 may correspond to 133 grayscale. Table 1 illustrates the peak white luminance PWL, the peak white grayscale PWG, the maximum grayscale MGR corresponding to the second point PT2, the full white luminance FWL, the full white grayscale FWG, and the intermediate grayscale SGR corresponding to the fourth point PT4 according to the scale factor mode SFM.

TABLE 1

| SFM | PWL (nits) | PWG (grayscale) | MGR (grayscale) | FWL (nits) | FWG (grayscale | SGR (grayscale) |
|---|---|---|---|---|---|---|
| SFC1 | 1000 | 255 | 255 | 200 | 123 | 123 |
| SFC2 | 800 | 230 | 255 | 150 | 108 | 119 |
| SFC3 | 500 | 186 | 255 | 100 | 90 | 123 |
| SFC4 | 300 | 147 | 255 | 50 | 66 | 113 |

The first compensated voltage curve VCC1 may have the maximum voltage VT2 at the second point PT2 and the minimum voltage VT1 at the fourth point PT4. A voltage VT2 of the second point PT2 of the first compensated voltage curve VCC1 may be equal to a voltage VT2 of the first point PT1 of the first reference voltage curve VCR1, and a voltage VT1 of the fourth point PT4 of the first compensated voltage curve VCC1 may be equal to a voltage VT1 of the third point PT3 of the first reference voltage curve VCR1. A voltage VT2 of a fifth point PT5 with respect to the minimum grayscale mGR of the first compensated voltage curve VCC1 may be equal to the voltage VT2 of the second point PT2. Accordingly, the voltage VT2 for the minimum grayscale mGR of the first compensated voltage curve VCC1 may be equal to the voltage VT2 for the maximum grayscale MGR of the first compensated voltage curve VCC1.

The voltage of the first compensated voltage curve VCC1 may linearly decrease from the fifth point PT5 to the fourth point PT4, and may linearly increase from the fourth point PT4 to the second point PT2. Accordingly, the first compensated voltage curve VCC1 may have a 'V' shape which has the maximum voltage VT2 at the fifth point PT5 for the minimum grayscale mGR and at the second point PT2 for the maximum grayscale MGR and has the minimum voltage VT1 at the fourth point PT4 for the intermediate grayscale SGR.

The voltage curve generator 174 may generate a second compensated voltage curve VCC2 and additional compensated voltage curves between the first compensated voltage curve VCC1 and the second compensated voltage curve VCC2 based on the first compensated voltage curve VCC1. The first compensated voltage curve VCC1 may represent a voltage with respect to a grayscale when the load LD of the input image data IMD1 is the minimum load (e.g., 0%), and the second compensated voltage curve VCC2 may represent a voltage with respect to a grayscale when the load LD of the input image data IMD1 is the maximum load (e.g., 100%).

A voltage of a sixth point PT6 with respect to the maximum grayscale MGR of the second compensated voltage curve VCC2 may be greater than the voltage VT2 of the second point PT2 by the voltage drop amount VDA of the driving voltage ELVDD corresponding to the peak white luminance PWL, and a voltage of a seventh point PT7 with respect to the intermediate grayscale SGR of the second compensated voltage curve VCC2 may be greater than the voltage VT1 of the fourth point PT4 by the voltage drop amount VDA of the driving voltage ELVDD corresponding to the full white luminance FWL. A voltage of an eighth point PT8 with respect to the minimum grayscale mGR of the second compensated voltage curve VCC2 may be equal to the voltage of the sixth point PT6. Accordingly, the voltage for the minimum grayscale mGR of the second compensated voltage curve VCC2 may be equal to the voltage for the maximum grayscale MGR of the second compensated voltage curve VCC2.

The voltage of the second compensated voltage curve VCC2 may linearly decrease from the eighth point PT8 to the seventh point PT7, and may linearly increase from the seventh point PT7 to the sixth point PT6. Accordingly, the second compensated voltage curve VCC2 may have a 'V' shape which has the maximum voltage at the eighth point PT8 for the minimum grayscale mGR and at the sixth point PT6 for the maximum grayscale MGR and has the minimum voltage at the seventh point PT7 for the intermediate grayscale SGR.

Figure 14:
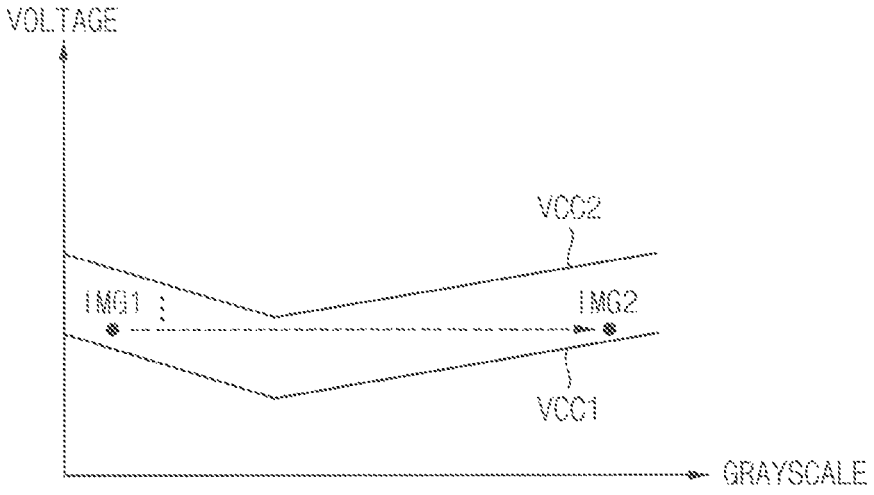
FIG. 14 is a graphical diagram illustrating compensated voltage curves according to an embodiment.
Figure 15:
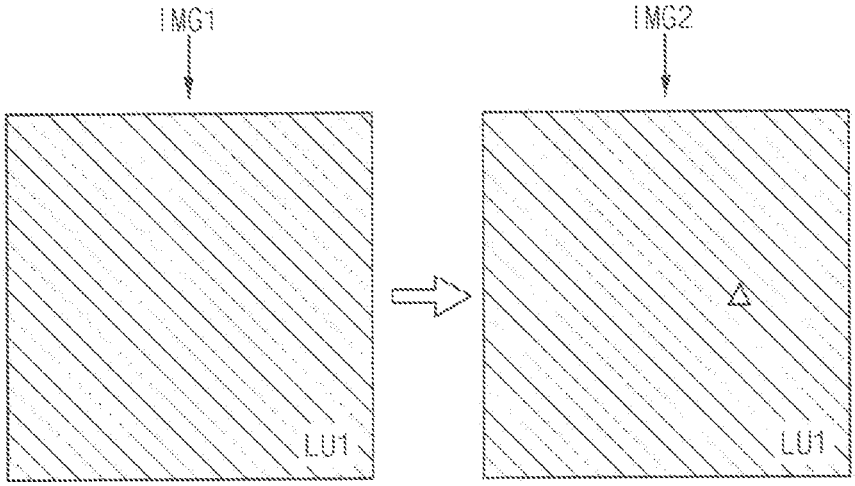
FIG. 15 is a block diagram for describing a change in luminance due to a change in image according to an embodiment.

FIG. 14 illustrates compensated voltage curves VCC1 and VCC2 according to an embodiment. FIG. 15 is used for describing a change in luminance due to a change in image according to an embodiment.

Referring to FIGS. 14 and 15, in an embodiment of the present disclosure, the driving voltage controller 160 may generate a driving voltage ELVDD from the compensated voltage curves VCC1, . . . , VCC2 based on the load LD and the maximum grayscale value MGV of the input image data IMD1. When a first image IMG1 is displayed in a first frame period and a second image IMG2 is displayed in a second frame period after the first frame period, the driving voltage controller 160 may generate the driving voltage ELVDD in the first and second frame periods from the compensated voltage curves VCC1, . . . , VCC2 based on the load LD and maximum grayscale value MGV of the input image data IMD1 corresponding to the first and second images IMG1 and IMG2. For example, the first image IMG1 may be a background image of 16 grayscale, and the second image IMG2 may be an image in which a small triangle of 255 grayscale is displayed on a background of 16 grayscale.

Since the load LD of the input image data IMD1 corresponding to the first image IMG1 and the load LD of the input image data IMD1 corresponding to the second image IMG2 are relatively small, a compensated voltage curve adjacent to the first compensated voltage curve VCC1 may be selected from the compensated voltage curves VCC1, . . . , VCC2. Further, since the maximum grayscale value MGV of the input image data IMD1 corresponding to the first image IMG1 is 16 grayscale and the maximum grayscale value MGV of the input image data IMD1 corresponding to the second image IMG2 is 255 grayscale, a difference between the magnitude of the driving voltage ELVDD generated in the second frame period displaying the second image IMG2 and the magnitude of the driving voltage ELVDD generated in the first frame period displaying the first image IMG1 may be very small. In this case, since the difference in magnitude of the driving voltage ELVDD provided to the pixel PX are very small when the magnitudes of the data signals DS provided to the pixel PX are the same in the first and second frame periods, the first luminance LU1 of the background of the second image IMG2 may be substantially equal to the first luminance LU1 of the background of the first image IMG1. A change in background luminance due to the change in image (IMG1→IMG2) need not occur, and accordingly, the image quality of the display device 100 may be optimized.

Figure 16:
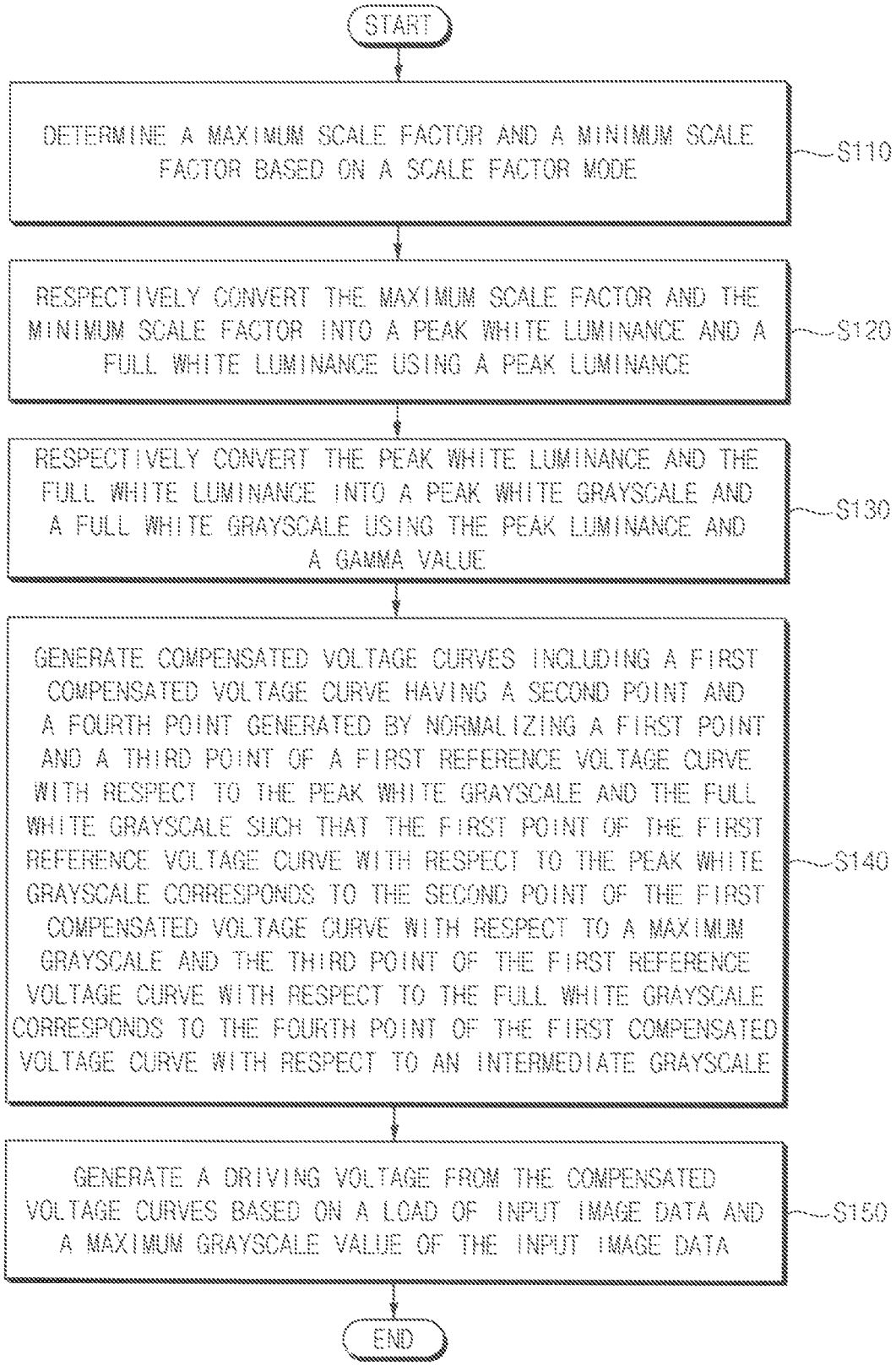
FIG. 16 is a flowchart diagram illustrating a method of driving a display device according to an embodiment.

FIG. 16 illustrates a method of driving a display device according to an embodiment.

Referring to FIGS. 12 and 16, in the method of driving the display device, the scale factor determiner 171 may determine the maximum scale factor MSF and the minimum scale factor mSF based on the scale factor mode SFM (S110).

The luminance calculator 172 may respectively convert the maximum scale factor MSF and the minimum scale factor mSF into the peak white luminance PWL and the full white luminance FWL using the peak luminance PLU (S120). The peak white luminance PWL may be calculated by multiplying the peak luminance PLU by the maximum scale factor MSF, and the full white luminance FWL may be calculated by multiplying the peak luminance PLU by the minimum scale factor mSF.

The grayscale calculator 173 may respectively convert the peak white luminance PWL and the full white luminance FWL into the peak white grayscale PWG and the full white grayscale FWG using the peak luminance PLU and the gamma value GMV (S130). The peak white grayscale PWG may be calculated by multiplying the maximum grayscale (e.g., 255 grayscale) by the ratio of the peak white luminance PWL to the peak luminance PLU and applying the gamma value GMV, and the full white grayscale FWG may be calculated by multiplying the maximum grayscale by the ratio of the full white luminance FWL to the peak luminance PLU and applying the gamma value GMV.

Referring to FIGS. 12, 13, and 16, the voltage curve generator 174 may generate the first compensated voltage curve VCC1 including the second point PT2 and the fourth point PT4 generated by normalizing the first point PT1 and the third point PT3 of the first reference voltage curve VCR1 with respect to the peak white grayscale PWG and the full white grayscale FWG based on the entire grayscale such that the first point PT1 of the first reference voltage curve VCR1 with respect to the peak white grayscale PWG corresponds to the second point PT2 of the first compensated voltage curve VCC1 with respect to the maximum grayscale MGR and the third point PT3 of the first reference voltage curve VCR1 with respect to the full white grayscale FWG corresponds to the fourth point PT4 of the first compensated voltage curve VCC1 with respect to the intermediate grayscale SGR (S140).

The first compensated voltage curve VCC1 may have the maximum voltage VT2 at the second point PT2 and the minimum voltage VT1 at the fourth point PT4. The voltage VT2 of the second point PT2 of the first compensated voltage curve VCC1 may be equal to the voltage VT2 of the first point PT1 of the first reference voltage curve VCR1, and the voltage VT1 of the fourth point PT4 of the first compensated voltage curve VCC1 may be equal to the voltage VT1 of the third point PT3 of the first reference voltage curve VCR1. The voltage VT2 of the fifth point PT5 with respect to the minimum grayscale mGR of the first compensated voltage curve VCC1 may be equal to the voltage VT2 of the second point PT2. Accordingly, the voltage VT2 for the minimum grayscale mGR of the first compensated voltage curve VCC1 may be equal to the voltage VT2 for the maximum grayscale MGR of the first compensated voltage curve VCC1.

The voltage of the first compensated voltage curve VCC1 may linearly decrease from the fifth point PT5 to the fourth point PT4, and may linearly increase from the fourth point PT4 to the second point PT2. Accordingly, the first compensated voltage curve VCC1 may have a 'V' shape which has the maximum voltage VT2 at the fifth point PT5 for the minimum grayscale mGR and at the second point PT2 for the maximum grayscale MGR and has the minimum voltage VT1 at the fourth point PT4 for the intermediate grayscale SGR.

The voltage curve generator 174 may generate the second compensated voltage curve VCC2 and the additional compensated voltage curves between the first compensated voltage curve VCC1 and the second compensated voltage curve VCC2 based on the first compensated voltage curve VCC1.

The first compensated voltage curve VCC1 may represent a voltage with respect to a grayscale when the load LD of the input image data IMD1 is the minimum load, and the second compensated voltage curve VCC2 may represent a voltage with respect to a grayscale when the load LD of the input image data IMD1 is the maximum load.

The shape of the second compensated voltage curve VCC2 may be the same as the shape of the first compensated voltage curve VCC1, and the voltage of the second compensated voltage curve VCC2 may be greater than the voltage of the first compensated voltage curve VCC1 by the voltage drop amount VDA of the driving voltage ELVDD when the load LD of the input image data IMD1 is the maximum load. Accordingly, the voltage curve generator 174 may generate the second compensated voltage curve VCC2 by increasing the voltage of the first compensated voltage curve VCC1 by the voltage drop amount VDA.

Referring to FIGS. 7 and 16, the driving voltage controller 160 may generate the driving voltage ELVDD from the compensated voltage curves VCC based on the load LD of the input image data IMD1 and the maximum grayscale value MGV of the input image data IMD1 (S150). One compensated voltage curve may be selected from the compensated voltage curves VCC based on the load LD of the input image data IMD1, and one point may be selected from points of the selected compensated voltage curve based on the maximum grayscale value MGV of the input image data IMD1. The driving voltage controller 160 may determine a voltage corresponding to the selected point as the driving voltage ELVDD, and may provide the determined driving voltage ELVDD to the display panel 110.

A display device according to embodiments of the present disclosure may be embodied in a display device included in a computer, a notebook, a mobile phone, a smart phone, a smart pad, a PMP, a PDA, an MP3 player, or the like.

Although display devices and the methods of driving display devices according to embodiments of the present disclosure have been described with reference to the drawings, the illustrated embodiments are examples, and may be modified and changed by a person having ordinary knowledge in the relevant technical field or those of ordinary skill in the pertinent art without departing from the technical scope and spirit set forth in the following claims.

What is claimed is:

1. A display device, comprising: a display panel configured to display an image based on output image data into which input image data is converted; a voltage curve controller configured to calculate a peak white grayscale and a full white grayscale based on a scale factor mode set by a user, and to generate compensated voltage curves including a first compensated voltage curve having a second point with respect to a maximum grayscale and a fourth point with respect to an intermediate grayscale generated by normalizing a first point and a third point of a first reference voltage curve with respect to the peak white grayscale and the full white grayscale based on an entire grayscale; and a driving voltage controller configured to generate a driving voltage from the compensated voltage curves based on a load of the input image data and a maximum grayscale value of the input image data, and to provide the driving voltage to the display panel.

2. The display device of claim 1, wherein the second point and the fourth point of the first compensated voltage curve respectively correspond to the first point and the third point of the first reference voltage curve, and wherein the first compensated voltage curve has a maximum voltage at the second point, and has a minimum voltage at the fourth point.

3. The display device of claim 2, wherein a voltage of the second point is equal to a voltage of the first point, and wherein a voltage of the fourth point is equal to a voltage of the third point.

4. The display device of claim 3, wherein the first compensated voltage curve further includes a fifth point with respect to a minimum grayscale, and wherein a voltage of the fifth point is equal to the voltage of the second point.

5. The display device of claim 4, wherein the voltage of the first compensated voltage curve linearly decreases from the fifth point to the fourth point, and linearly increases from the fourth point to the second point.

6. The display device of claim 4, wherein the minimum grayscale and the maximum grayscale are respectively 0 grayscale and 255 grayscale.

7. The display device of claim 1, wherein the first compensated voltage curve indicates a voltage with respect to a grayscale when the load of the input image data is a minimum load.

8. The display device of claim 7, wherein the compensated voltage curves further includes a second compensated voltage curve indicating a voltage with respect to a grayscale when the load of the input image data is a maximum load, and wherein the voltage curve controller generates the second compensated voltage curve based on the first compensated voltage curve.

9. The display device of claim 8, wherein the second compensated voltage curve includes a sixth point with respect to the maximum grayscale and a seventh point with respect to the intermediate grayscale, wherein a voltage of the sixth point is greater than the voltage of the second point by a voltage drop amount of the driving voltage corresponding to a peak white luminance calculated based on the peak white grayscale, and wherein a voltage of the seventh point is greater than the voltage of the fourth point by a voltage drop amount of the driving voltage corresponding to a full white luminance calculated based on the full white grayscale.

10. The display device of claim 1, wherein the voltage curve controller includes:

a scale factor determiner configured to determine a maximum scale factor and a minimum scale factor of a scale factor curve selected based on the scale factor mode;

a luminance calculator configured to respectively convert the maximum scale factor and the minimum scale factor into a peak white luminance and a full white luminance using a peak luminance;

a grayscale calculator configured to respectively convert the peak white luminance and the full white luminance into the peak white grayscale and the full white grayscale using the peak luminance and a gamma value; and a voltage curve generator configured to generate the compensated voltage curves based on the peak white grayscale, the full white grayscale, and the first reference voltage curve.

11. The display device of claim 10, wherein the peak white luminance is calculated by multiplying the peak luminance by the maximum scale factor, and wherein the full white luminance is calculated by multiplying the peak luminance by the minimum scale factor.

12. The display device of claim 10, wherein the peak white grayscale is calculated by applying the gamma value to a ratio of the peak white luminance to the peak luminance, and wherein the full white grayscale is calculated by applying the gamma value to a ratio of the full white luminance to the peak luminance.

13. The display device of claim 1, wherein the driving voltage controller includes:

a load calculator configured to calculate the load of the input image data;

a maximum grayscale calculator configured to calculate the maximum grayscale value of the input image data; and a driving voltage generator configured to generate the driving voltage from the compensated voltage curves based on the load of the input image data and the maximum grayscale value of the input image data.

14. The display device of claim 1, further comprising:

a power controller configured to calculate the load of the input image data, and to calculate a scale factor from a scale factor curve selected based on the scale factor mode according to the load of the input image data; and a timing controller configured to convert the input image data into the output image data using the scale factor.

15. A method of driving a display device, the method comprising: calculating a peak white grayscale and a full white grayscale based on a scale factor mode set by a user; generating compensated voltage curves including a first compensated voltage curve having a second point with respect to a maximum grayscale and a fourth point with respect to an intermediate grayscale generated by normalizing a first point and a third point of a first reference voltage curve with respect to the peak white grayscale and the full white grayscale based on an entire grayscale; and generating a driving voltage from the compensated voltage curves based on a load of the input image data and a maximum grayscale value of the input image data.

16. The method of claim 15, wherein the second point and the fourth point of the first compensated voltage curve respectively correspond to the first point and the third point of the first reference voltage curve, and wherein the first compensated voltage curve has a maximum voltage at the second point, and has a minimum voltage at the fourth point.

17. The method of claim 16, wherein a voltage of the second point is equal to a voltage of the first point, and wherein a voltage of the fourth point is equal to a voltage of the third point.

18. The method of claim 17, wherein the first compensated voltage curve further includes a fifth point with respect to a minimum grayscale, and wherein a voltage of the fifth point is equal to the voltage of the second point.

19. The method of claim 18, wherein the voltage of the first compensated voltage curve linearly decreases from the fifth point to the fourth point, and linearly increases from the fourth point to the second point.

20. The method of claim 15, wherein calculating the peak white grayscale and the full white grayscale based on the scale factor mode includes:

determining a maximum scale factor and a minimum scale factor of a scale factor curve selected based on the scale factor mode;

respectively converting the maximum scale factor and the minimum scale factor into a peak white luminance and a full white luminance using a peak luminance; and respectively converting the peak white luminance and the full white luminance into the peak white grayscale and the full white grayscale using the peak luminance and a gamma value.

* * * * *